US006824419B1

(12) United States Patent
Wu

(10) Patent No.: US 6,824,419 B1
(45) Date of Patent: Nov. 30, 2004

(54) ELECTRICAL CONNECTOR ASSEMBLY WITH BLIND MATE STRUCTURE

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/658,563

(22) Filed: Sep. 8, 2003

(51) Int. Cl.[7] ..... H01R 13/64; H01R 13/62
(52) U.S. Cl. ..... 439/378; 439/366
(58) Field of Search ..... 439/378, 246, 439/247, 296, 364, 366

(56) References Cited

U.S. PATENT DOCUMENTS 4,647,130 A 3/1987 Blair et al.
4,915,641 A 4/1990 Miskin et al.
5,199,900 A 4/1993 Hayes, Sr.
5,228,867 A * 7/1993 Nagamine ..... 439/364
5,356,300 A 10/1994 Costello et al.
5,466,171 A 11/1995 Bixler et al.
5,514,000 A 5/1996 Krause et al.
5,547,385 A 8/1996 Spangler
6,290,536 B1 9/2001 Hwang et al.
6,468,108 B1 * 10/2002 Wu ..... 439/567
6,556,411 B1 * 4/2003 Hoeft et al. ..... 361/119

* cited by examiner

*Primary Examiner*—Chandrika Prasad
(74) *Attorney, Agent, or Firm*—Wei Te Chung

(57) ABSTRACT

An electrical connector assembly (100) includes matable first connector (200) and second connector (300). The first connector includes a first housing (1) forming a pair of flanges (12) on a pair of ends thereof and a pair of first guiding members (13) extending perpendicular thereto, a pair of fastening members (5) and a pair of blocking members (6). Each flange includes a first face (122) and an opposite second face (124). A mounting aperture (120) is defined through the flange and a cutout (121) recesses from the first face to communicate with the mounting aperture. The blocking member is received in the cutout and is secured between the fastening member and the flange. The second connector includes a second housing (8) forming a pair of second guiding members (84) corresponding to the first guiding members.

15 Claims, 9 Drawing Sheets

ELECTRICAL CONNECTOR ASSEMBLY WITH BLIND MATE STRUCTURE

BACKGROUND OF THE INVENTION

1. Field of the Invention

The present invention generally relates to an electrical connector assembly, and more particularly to a blind mate electrical connector assembly.

2. Description of Related Art

Cable connector assemblies are widely used for signal or power transmission between personal computers and peripheral equipments. Such a cable connector assembly is usually needed to be mounted to a panel and further engage with a mated complementary connector electrically connecting with a printed circuit board.

To mount to the panel, the cable connector assembly usually forms a pair of flanges on opposite ends thereof and employs a pair of jackscrews. The jackscrews protrude through corresponding apertures of the flanges and corresponding mounting holes defined in the panel to lock with a pair of locking nuts, thereby fastening the cable connector assembly with the panel. The jackscrew comprises an operating portion, a threaded portion for engaging with the locking nut and a medial portion interconnecting the operating portion with the threaded portion. When the locking nut is rotatably and movably actuated to engage with the threaded portion of the jackscrew, the operating portion of the jackscrew is required to be operated by a screwdriver or other tools. Obviously, it is inconvenient for the user assembling the cable connector assembly on the panel. Further, the jackscrew still has a possibility of moving away from the cable connector assembly under the actuating force of the locking nut during the assembly.

Additionally, to engage with the mated complementary connector, the cable connector assembly and the mated complementary connector generally each equips with a pair of guiding members to guide proper engagement therebetween. The guiding members may be a pair of guiding posts or a pair of post receiving cavities disposed on either the cable connector or the mated complementary connector. U.S. Pat. Nos. 5,356,300, 5,466,171 and 5,547,385 each disclose a pair of board mount connectors having such a pair of guiding posts and a pair of post receiving cavities.

However, each guiding post disclosed in the above references has a lengthwise distance from a housing. This inevitably increases a lengthwise size of the connector on which the guiding post is formed. It is out of the current trend of miniaturization.

Hence, an improved blind mate electrical connector assembly is highly desired to overcome the disadvantages of the prior art.

SUMMARY OF THE INVENTION

Accordingly, an object of the present invention is to provide an electrical connector assembly with a minimized lengthwise size.

Another object of the present invention is to provide a cable connector assembly mounting to a panel conveniently and reliably.

In order to achieve the objects set forth, a cable connector assembly in accordance with the present invention comprises an insulative housing, a plurality of conductive contacts received in the housing, a flat cable comprising a plurality of conductors respectively electrically connecting with the contacts, an insulative cover cooperating with the housing to sandwich the cable therebetween, a pair of fastening members and a pair of blocking members. The insulative housing comprises a pair of flanges formed on a pair of ends thereof. Each flange comprises a first face and a second face opposite to the first face. A mounting aperture is defined through the flange and a cutout recesses from the first face to communicate with the mounting aperture. The fastening member comprises an operating portion, a threaded portion and a medial portion interconnecting the operating portion and the threaded portion. The medial portion defines a recess extending inwardly from a periphery thereof, and the blocking member is received in the recess and secured between the fastening member and the flange for preventing the fastening members moving away from the flanges.

Other objects, advantages and novel features of the invention will become more apparent from the following detailed description when taken in conjunction with the accompanying drawings.

DETAILED DESCRIPTION OF THE INVENTION

Figure 1:
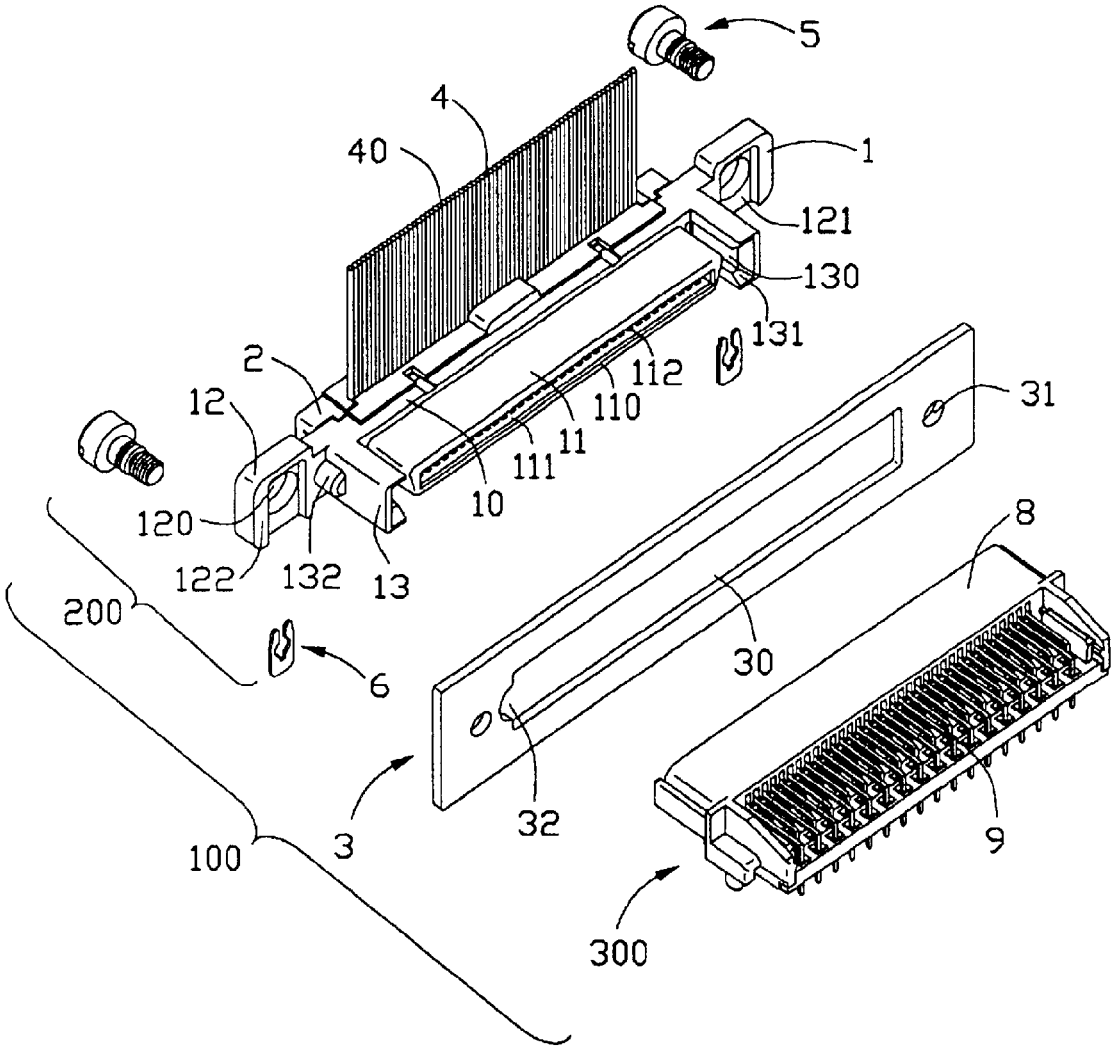
FIG. 1 is a partially exploded, perspective view of an electrical connector assembly in accordance with the present invention.
Figure 2:
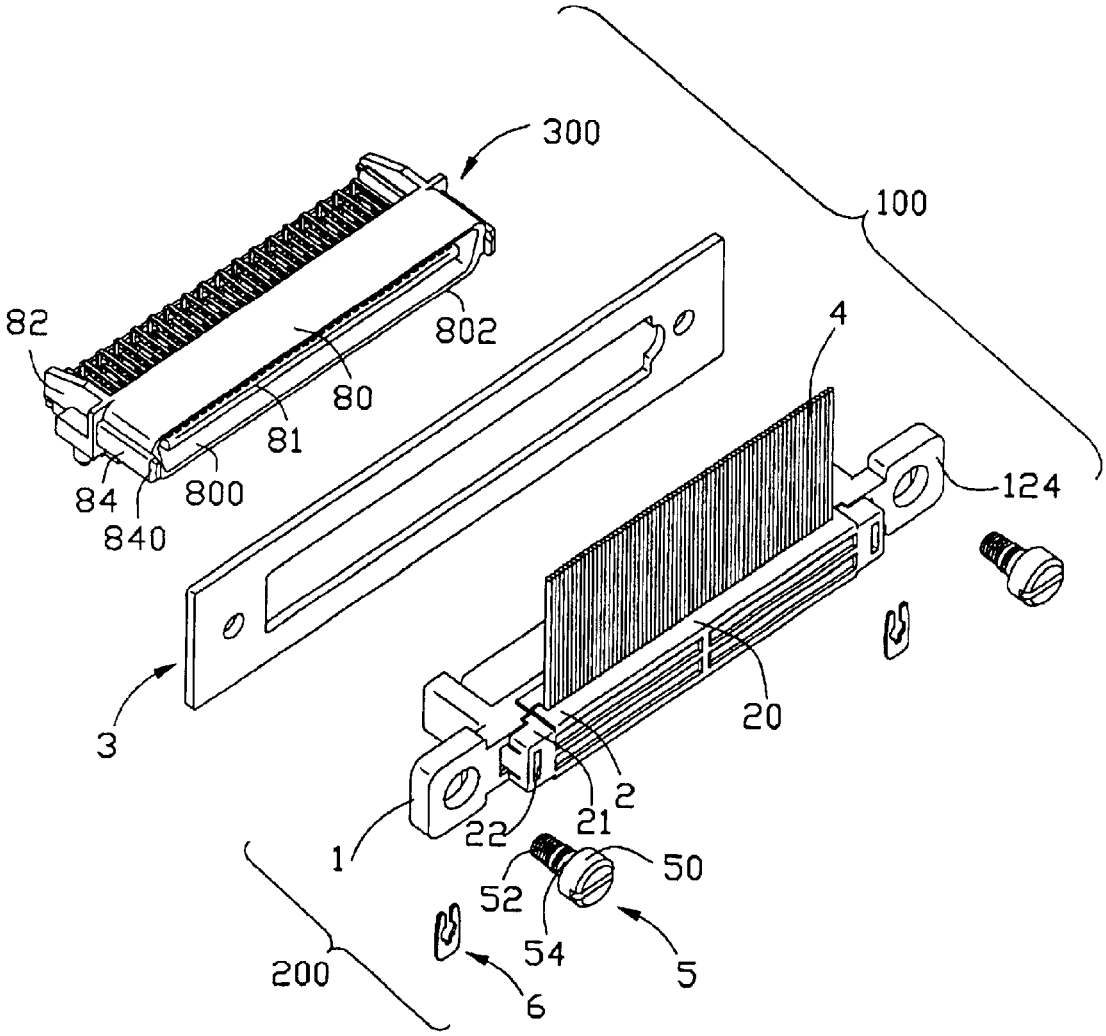
FIG. 2 is a view similar to FIG. 1, but taken from a different aspect.

Reference will now be made in detail to the preferred embodiment of the present invention. Referring to FIG. 1 and FIG. 2, an electrical connector assembly 100 in accordance with the present invention comprises a first connector 200, a second connector 300 mated with the first connector 200 and a panel 3 to which the first connector 200 and a plurality of different connectors are mounted for modularization.

Figure 7:
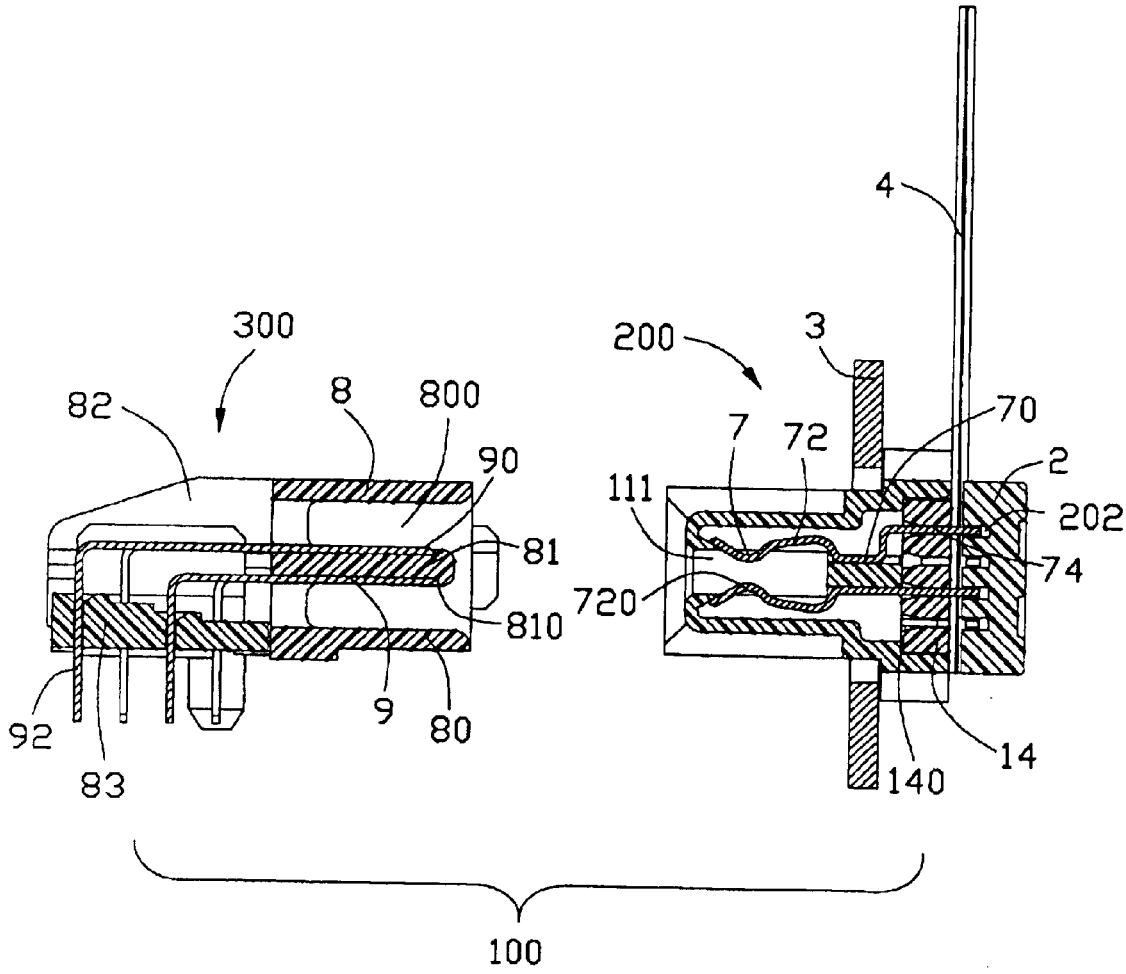
FIG. 7 is a cross-sectional view of the electrical connector assembly of FIG. 5 taken along line 7—7.
Figure 8:
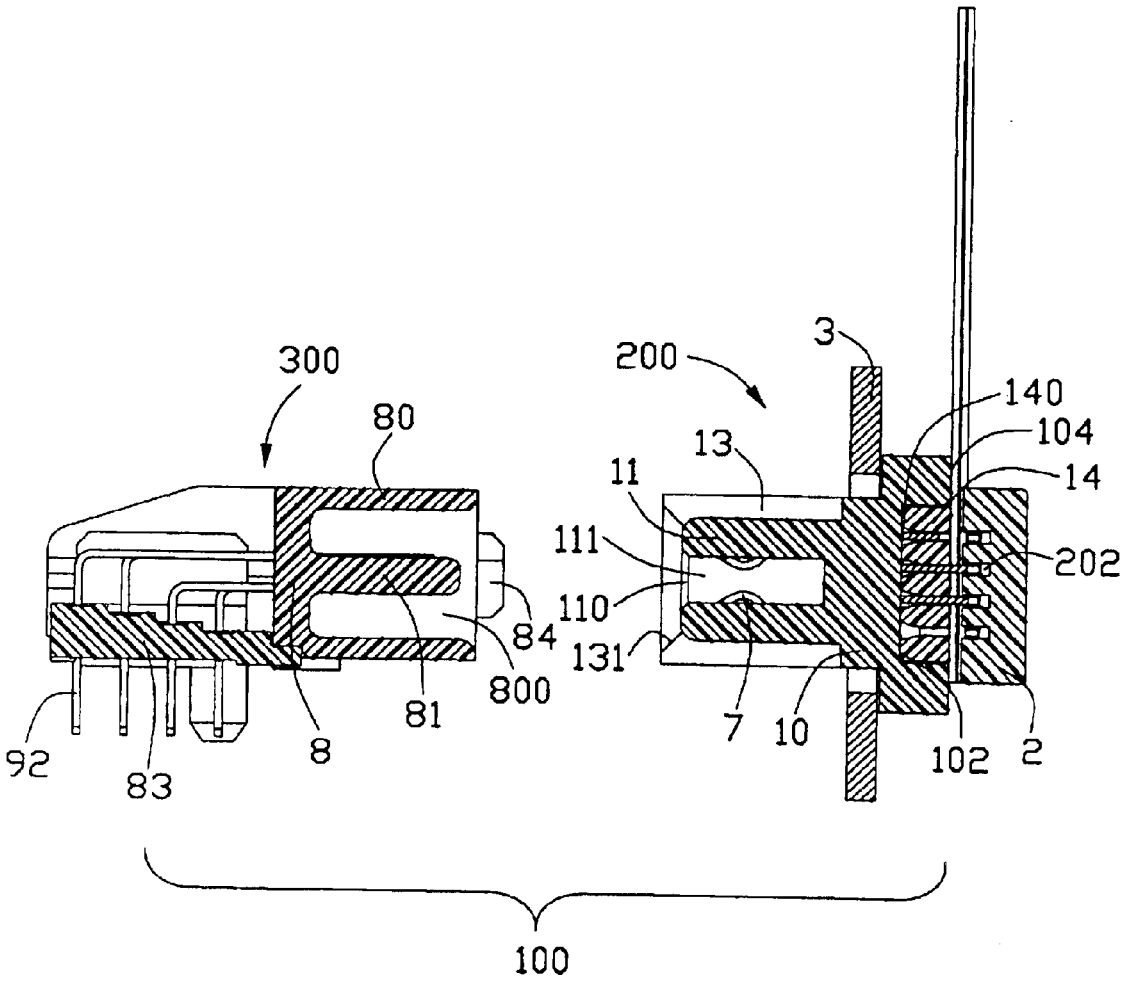
FIG. 8 is a cross-sectional view of the electrical connector assembly of FIG. 5 taken along line 8—8.
Figure 9:
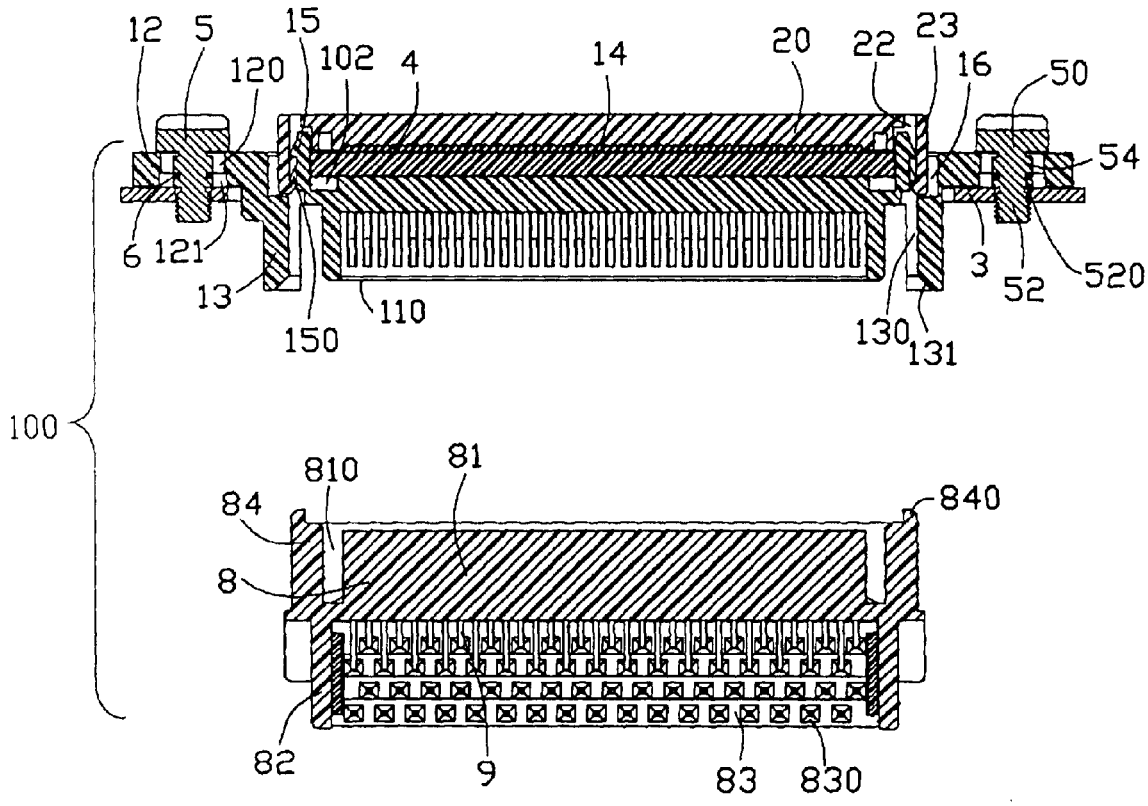
FIG. 9 is a cross-sectional view of the electrical connector assembly of FIG. 5 taken along line 9—9.

Continuing to FIGS. 1–2 in conjunction with FIGS. 7–9, the first connector 200 comprises a first insulative housing 1, a plurality of first conductive contacts 7 assembled to the first housing 1, a cable 4 electrically connected with the first contacts 7, a cover 2 assembled to a rear of the first housing 1, a pair of fastening members 5 and a pair of blocking members 6.

The first insulative housing 1 is substantially elongated and comprises a base 10 and a mating portion 11 protruding outwardly from a center of the base 10. The first housing 1 also comprises a first mating face 110 and an opposite first terminating face 104 (FIG. 8).

The housing 1 defines a longitudinal direction and a lateral direction perpendicular to the longitudinal direction.

The base 10 forms a pair of flanges 12 extending oppositely in the longitudinal direction of the housing. Each flange 12 defines a mounting aperture 120 therethrough and a cutout 121 recesses from a first face 122 of the flange 12 toward an opposite second face 124 to communicate with the mounting aperture 120. The second face 124 is coplanar with the terminating face 104 of the first housing 1. A pair of first guiding members 13 protrude from the base 10 adjacent the mating portion 11 and beyond the first mating face 110. A U-shaped receiving cavity 130 is formed in each first guiding member 13. Each first guiding member 13 is chamfered to form a lead-in surface 131. A polarizing half-post 132 protrudes from one first guiding member 13 along a longitudinal direction of the first housing 1.

The mating portion 11 is substantially D-shaped and defines a first receiving space 111 recessed from the first mating face 110. A cavity 102 (FIG. 8) is defined from the first terminating face 104 toward the first mating face 110. A plurality of first passages 112 is defined through the housing 1 to communicate with the cavity 102 and the first receiving space 111. Particularly referring to FIGS. 8–9, a first spacer 14 is received in the cavity 102 and defines a plurality of first passageways 140 corresponding to the first passages 112. A pair of slits 16 are respectively defined through the base 10 and communicate with the receiving cavities 130. A pair of retaining portions 15 extends beyond the terminating face 104 and each is provided with a pair of wedges 150.

Referring to FIGS. 1–2 in conjunction with FIGS. 7–9, the cover 2 is made of insulative material and comprises a main body 20 and a pair of lateral ends 21. The main body 20 defines a plurality of grooves 202 (FIG. 7) in a front surface thereof. Each lateral end 21 defines a channel 22 therethrough and forms a latch 23 extending outwardly.

Referring to FIG. 1, in the preferred embodiment, the cable 4 is a ribbon cable and comprises a plurality of conductors 40.

Referring to FIGS. 7–8, each first conductive contact 7 comprises a first retention section 70, a first mating section 72 extending from one end of the first retention section 70 with a curved mating end 720, and a first tail section 74 extending from the other end of the first retention section 70.

Figure 3:
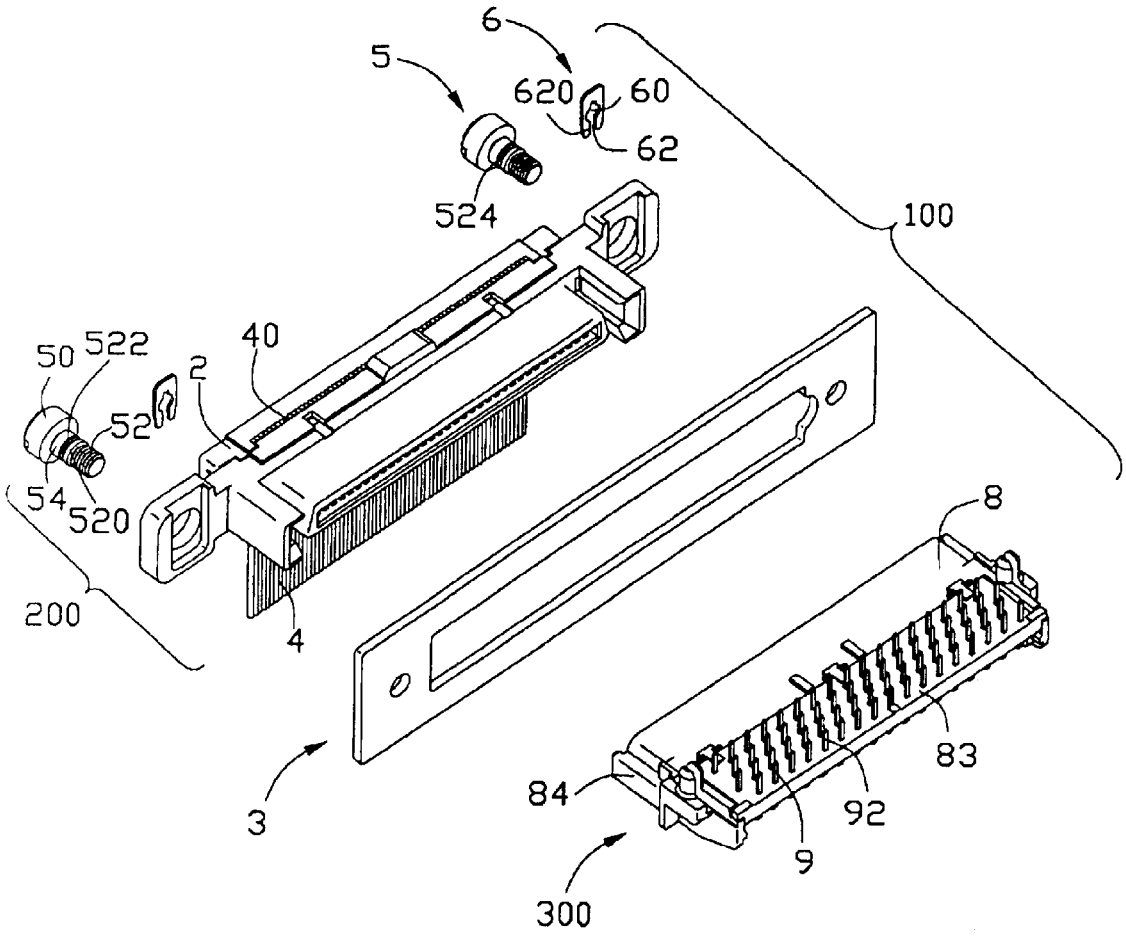
FIG. 3 is a view similar to FIG. 1, but taken from another different aspect.

Referring to FIGS. 1–3, each of the fastening members 5 is a jackscrew and comprises an enlarged operating portion 50, a threaded portion 52 and a medial portion 54 interconnecting the operating portion 50 with the threaded portion 52. A recess 522 is defined inwardly from the circumferential periphery of the medial portion 54 to form a thinner section 524 adjacent the threaded portion 52.

Referring to FIGS. 1–3, the blocking member 6 is of a C-ring shape and defines a circular hole 60 in a center thereof and a gap 62 leading the hole 60 to a lower edge of the blocking member 6. A pair of legs 620 are thus formed by the gap 62.

Referring to FIGS. 1–3, the panel 3 is a rectangular board and defines a mounting opening 30 in a center thereof and a pair of mounting holes 31 spaced by the mounting opening 30. A semicircular polarizing opening 32 is defined in the panel 3 to communicate with the mounting opening 31.

Referring to FIGS. 1–2, the second connector 300 comprises a second insulative housing 8 and a plurality of second conductive contacts 9 received in the second insulative housing 8.

Referring to FIGS. 1–4 in conjunction with FIGS. 7–9, the second insulative housing 8 comprises a shroud wall 80 defining a second receiving space 800 therein, a tongue portion 81 protruding into the second receiving space 810, and a pair of dividing walls 82 extending outwardly from opposite ends of the shroud wall 80. A plurality of second passages 810 is defined in opposite faces of the tongue portion 81. A second spacer 83 is assembled between the pair of dividing walls 82 with a plurality of second passageways 830 defined therethrough. A pair of second guiding members 84 are respectively formed integrally with opposite lateral ends of the shroud wall 80 and extending beyond a second mating face 802 of the shroud wall 80. Each second guiding member 84 is chamfered to form a tapered end 840.

Referring to FIGS. 7–8, each second conductive contact 9 is L-shaped and comprises a second mating section 90 and a second tail section 92 bending vertically from the second mating section 90. It can be seen from FIG. 7 that the second conductive contacts 9 are of different lengths so that the tail sections 92 are arranged in four rows in a lengthwise direction of the second insulative housing 8.

In assembly of the first connector 200, referring to FIGS. 1–4 in conjunction with FIGS. 7–9, the first conductive contacts 7 are respectively inserted into the first passages 112 with the curved mating ends 720 of the mating sections 72 exposed into the first receiving space 111. The first retention sections 70 interfere fit into corresponding first passages 112 for securing the first contacts 7 to the first housing 1. The first tail sections 74 protrude through corresponding first passageways 140 and extend beyond the terminating face 104 of the first housing 1. The conductors 40 of the cable 4 are respectively insulation displacement connected with the tail sections 74 to form an electrical connection between the cable 4 and the first contacts 7.

The insulative cover 2 is assembled to the first housing 1 with the pair of latches 23 thereof and the pair of retaining portions 15 of the first housing 1 respectively protruding through the slits 16 of the first housing 1 and the channels 22 of the cover 2 to latch each other. Thus, the cover 2 is securely attached to the first housing 1 and the cable 4 has no possibility of separating from the contacts 7.

Figure 4:
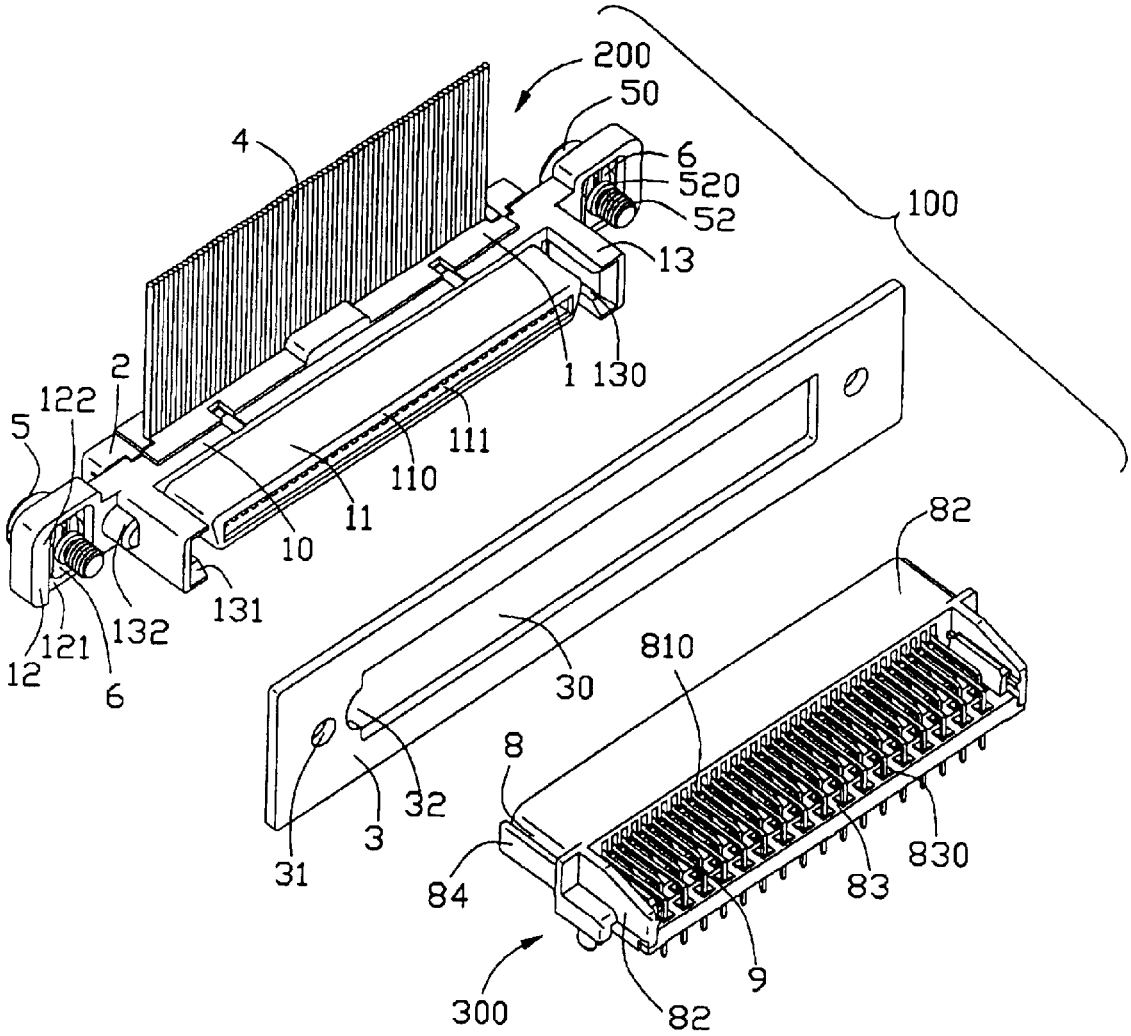
FIG. 4 is a partially assembled view of FIG. 1.
Figure 5:
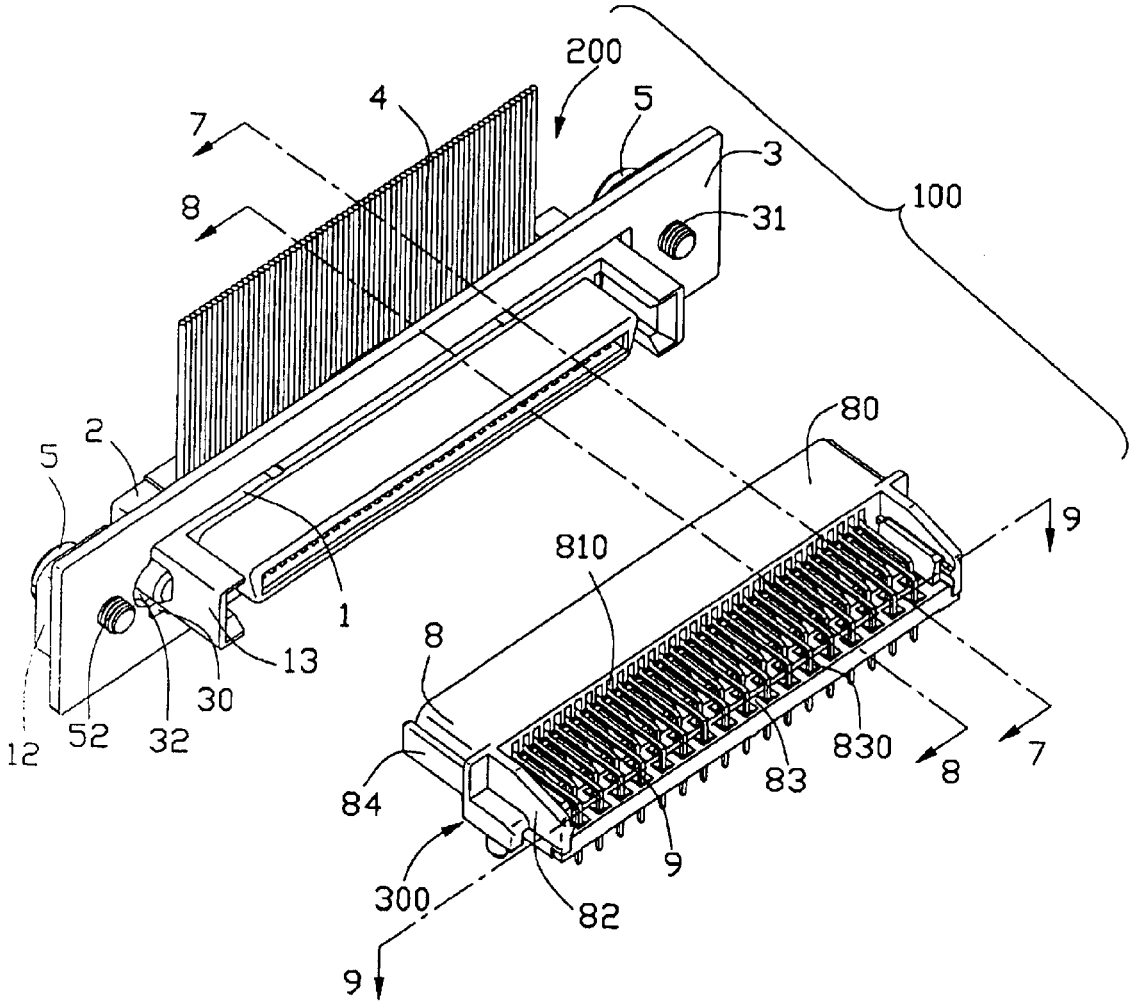
FIG. 5 is a partially assembled view of FIG. 4.
Figure 6:
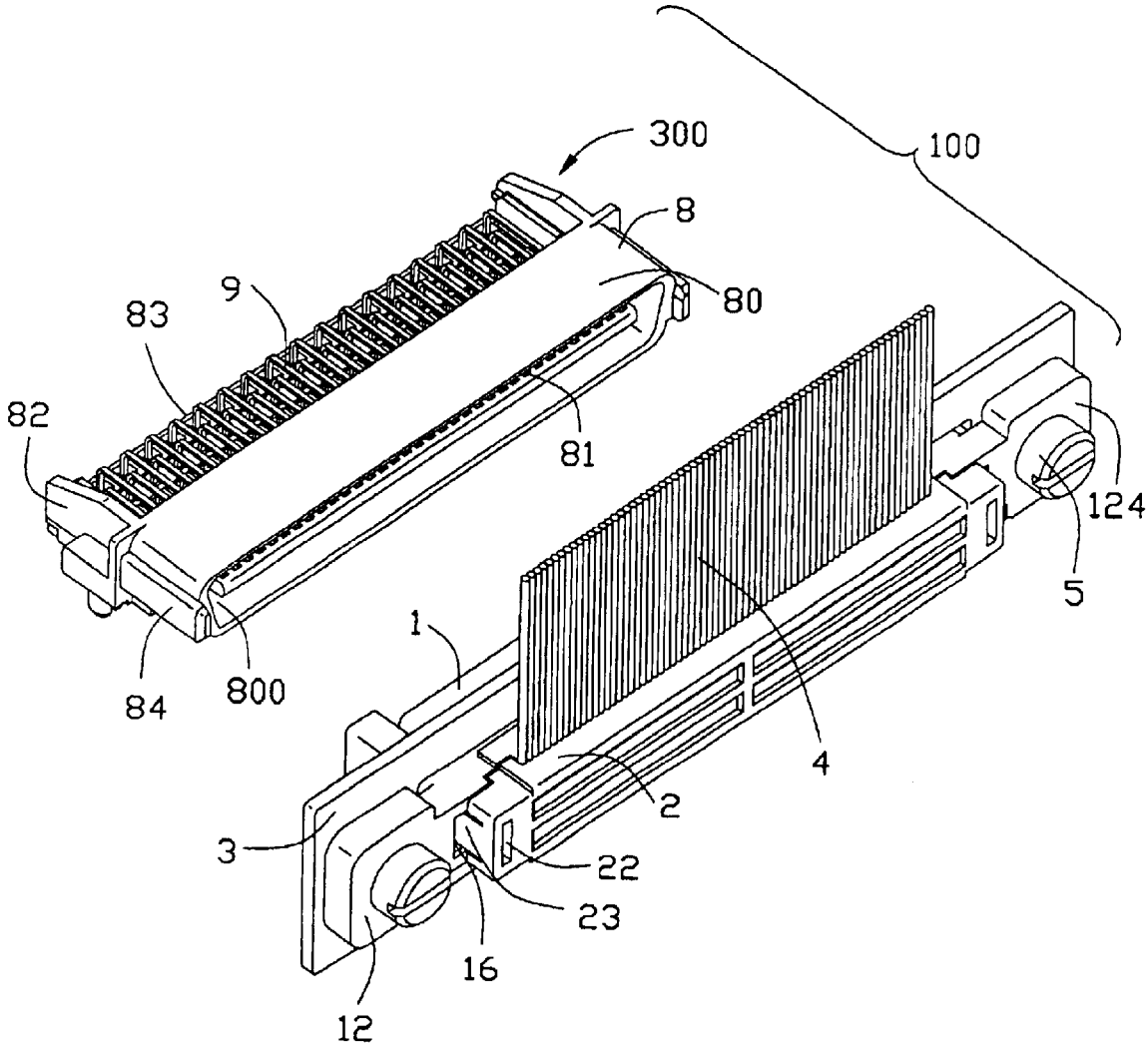
FIG. 6 is a view similar to FIG. 5, but taken from a different aspect.

Particularly referring to FIG. 4 and FIG. 9, the pair of fastening members 5 respectively protrude through the pair of mounting apertures 120 of the flanges 12. The operating portion 50 is exposed beyond the second face 124 of the flange 12. The medial portion 54 is received in the mounting aperture 120, the thinner section 524 and a forward section 520 of the medial portion 54 are received in the cutout 121. The threaded portion 52 is exposed beyond the first face 122 of the flange 12. Each blocking member 6 is pressed into the cutout 121 to engage with a corresponding fastening member 5. When pressing, the legs 621 are pressed to move away from each other by the thinner section 524 and finally the thinner section 524 is received in the circular hole 60 of the blocking member 6. Thus, the blocking member 6 is tightly sandwiched between the flange 12 and the fastening member 5. The operating portion 50 of each fastening member 5 is caused to abut against the second face of the flange 12 by the blocking member 6. Particularly referring to FIG. 4, a first dimension of the blocking member 6 perpendicular to the longitudinal direction and the lateral direction of the housing is larger than the diameter of the mounting aperture 120, and a second dimension of the blocking member 6 perpendicular to the first direction and parallel to the longitudinal direction is smaller than the diameter of the medial portion 54. Thus, the fastening member 5 has no possibility of moving away from the flange 12.

Referring to FIGS. 1–5 in conjunction with FIGS. 7–9, the panel 3 is assembled to the first connector 200. The mating portion 11 and the pair of first guiding members 13 protrude through the mounting opening 30 until the panel 3 abuts against the first face 122 of the flanges 12 with the polarizing post 132 received in the polarizing opening 32. The threaded portions 52 respectively protrude through the mounting holes 31. To secure the panel 3 to the first connector 200, an operator needs to screw a locking nut (not shown) to the threaded portion 52 of the fastening member 5. Since the existence of the blocking member 6, the lock between the locking nut and the fastening member 5 is relatively easy to achieve.

In assembly of the second connector 300, referring to FIGS. 1–6 in conjunction with FIGS. 7–9, the second conductive contacts 9 are respectively inserted into the second passages 810 with the second mating sections 90 thereof exposed into the second receiving space 800 for electrically connecting with corresponding first mating sections 72 of the first conductive contacts 7. The second tail sections 92 respectively protrude through the second passageways 830 of the second spacer 83 and beyond a bottom surface of the spacer 83 for being connected to a printed circuit board (not shown).

When mating, the mating portion 11 of the first connector 200 is received in the second receiving space 800 of the second connector 300 and the tongue portion 81 of the second connector 300 is received in the first receiving space 110 with the first and the second mating sections 72, 90 electrically connecting each other. The second guiding members 84 are respectively inserted and received into the receiving cavities 130 of the first guiding members 13. It should be noted that when in a blind mate condition, even the first connector 200 may have a relative departure to the second connector 300, the lead-in surface 131 and the tapered end 840 can also guide proper insertion of the first connector 200 into the second connector 300. In addition, since the second guiding member 84 is formed integrally with the shroud wall 80, a transverse size of the second connector 300 and a corresponding transverse size of the first connector 200 are thus decreased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mounting to a panel for modularization, comprising:

an insulative housing defining a longitudinal direction and a lateral direction perpendicular to said longitudinal direction, the insulative housing comprising a base and a mating portion projecting outwardly from a center of the base along said lateral direction and defining a receiving space, the base forming a pair of flanges on opposite ends thereof and a pair of guiding members extending beyond the mating portion along said lateral direction, each flange defining a mounting aperture therethrough and having a first face confronting the panel and a second face opposite to the first face, each guiding member defining a receiving cavity and forming with a polarizing half-post thereon;

a plurality of conductive contacts received in the insulative housing, each conductive contact comprising a mating section and a tail section opposite to the mating section;

a cable comprising a plurality of conductors respectively electrically connecting with the tail sections of the conductive contacts;

an insulative cover cooperating with the insulative housing to sandwich the cable between the cover and the insulative housing;

a pair of fastening members protruding through the mounting apertures of the insulative housing; and a pair of blocking members each secured between a corresponding fastening member and the flange.

2. The cable connector assembly as claimed in claim 1, wherein each flange defines a cutout recessed from the first face thereof to communicate with the mounting aperture, and wherein the blocking member is received in the cutout.

3. The cable connector assembly as claimed in claim 2, wherein the fastening member comprises an operating portion exposed beyond the second face of the flange, a threaded portion exposed beyond the first face of the flange and a medial portion interconnecting the operating portion and the threaded portion, and wherein the medial portion defines a recess extending inwardly from a peripheral thereof to receive the blocking member.

4. The cable connector assembly as claimed in claim 3, wherein a first dimension of the blocking member perpendicular to both the lateral direction of the housing and the longitudinal direction of the housing is larger than the diameter of the mounting aperture of the flange, and a second dimension of the blocking member perpendicular to said first dimension and parallel to said longitudinal direction is smaller than the diameter of the medial portion of the fastening member.

5. The cable connector assembly as claimed in claim 1, wherein the blocking member is of a c-ring shape.

6. The cable connector assembly as claimed in claim 1, further comprising a spacer, and wherein the housing comprises a mating face and a terminating face opposite to the mating face, a cavity is defined from the terminating face toward the mating face to receive the spacer.

7. The cable connector assembly as claimed in claim 6, wherein the housing defines a plurality of passages communicating with the receiving space, and wherein said spacer defines a plurality of passageways corresponding to the passages, the conductive contacts being respectively received in the passages and the passageways.

8. The cable connector assembly as claimed in claim 7, wherein the mating section of each conductive contact forms a curved mating end partially exposed in the receiving space.

9. The cable connector assembly as claimed in claim 6, wherein the housing forms a retaining portion extending beyond the terminating face thereof and a slit beside the retaining portion, and wherein the insulative cover forms a latch received in the slit and latching with the retaining portion.

10. The cable connector assembly as claimed in claim 9, wherein the slit communicates with the receiving cavity of the guiding member.

11. The cable connector assembly as claimed in claim 1, wherein the guiding member is chamfered at a free end thereof to form a lead-in surface.

12. The cable connector assembly as claimed in claim 1, wherein the mating portion is D-shaped.

13. An electrical connector assembly comprising:

a first connector comprising:

a first insulative housing comprising a base, a mating portion projecting forwardly from the base, and a first receiving space defined in the mating portion, the base forming a pair of flanges on opposite ends thereof and a pair of first guiding members extending perpendicularly thereto and beyond the mating portion, each flange defining a mounting aperture therein;

a plurality of first conductive contacts received in the first insulative housing;

a cable comprising a plurality of conductors electrically connecting with the first conductive contacts;

a cover cooperating with the insulative housing to sandwich the cable therebetween;

a pair of fastening members; and a pair of blocking members;

a second connector matable with the first connector comprising:

a second insulative housing comprising a tongue portion and a shroud wall surrounding the tongue portion to form a second receiving space, the shroud wall integrally formed with a pair of second guiding members extending outwardly therefrom to respectively engage with corresponding first guiding members; and a plurality of second conductive contacts received in opposite sides of the tongue portion and electrically connecting with the first conductive contacts; and a panel defining a mounting opening and a pair of mounting holes therein, the mating portion of the first connector protruding through the mounting opening and the pair of fastening members respectively protruding through the pair of apertures of the flanges and the pair of mounting holes of the panel to secure the first connector to the panel, each blocking member engaged with a corresponding fastening member and secured between the fastening member and the flange;

the first and the second guiding members respectively chamfered to facilitate the blind mate between the first and the second connectors.

14. The electrical connector assembly as claimed in claim 13, wherein the blocking member is of a C-ring shape, and the fastening member defines a recess therein to receive the blocking member.

15. The electrical connector assembly as claimed in claim 13, wherein each first guiding member forms a polarizing half-post thereon, and wherein the panel defines a polarizing opening communicating with the mounting opening to receive the half-post.

* * * * *